US008443740B2

(12) United States Patent
Romeo

(10) Patent No.: US 8,443,740 B2
(45) Date of Patent: May 21, 2013

(54) CYCLONIC INCINERATOR

(75) Inventor: Marlin Romeo, Mayerthrope (CA)

(73) Assignee: Maralto Environmental Technologies Ltd., Mayerthorpe, Alberta ( * ) Notice: Subject to any disclaimer, the term of this patent is extended or adjusted under 35 U.S.C. 154(b) by 637 days.

(21) Appl. No.: 12/514,557

(22) PCT Filed: Nov. 1, 2007

(86) PCT No.: PCT/CA2007/001959

§ 371 (c)(1),
(2), (4) Date: May 12, 2009

(87) PCT Pub. No.: WO2008/058370

PCT Pub. Date: May 22, 2008

(65) Prior Publication Data

US 2010/0242812 A1 Sep. 30, 2010

(30) Foreign Application Priority Data

Nov. 15, 2006 (CA) ..... 2569233

(51) Int. Cl.
*F23G 5/32* (2006.01)

(52) U.S. Cl.
USPC ..... 110/241; 110/235; 110/244; 110/238; 110/264; 110/263; 431/9; 431/173; 431/157; 431/355; 432/72

(58) Field of Classification Search ..... 110/241, 110/235, 244, 238, 264, 263; 432/72; 431/9, 431/173, 157, 355
See application file for complete search history.

(56) References Cited

U.S. PATENT DOCUMENTS

| | | | | |
|---|---|---|---|---|
| 3,236,743 | A * | 2/1966 | Pierson | 435/290.4 |
| 3,426,513 | A * | 2/1969 | Bauer | 55/459.1 |
| 3,445,192 | A * | 5/1969 | Woodland et al. | 422/224 |
| 3,682,117 | A * | 8/1972 | Rousseau | 110/216 |
| 3,830,172 | A * | 8/1974 | Hindenlang | 110/238 |
| 4,424,755 | A | 1/1984 | Caffyn et al. | |
| 4,725,223 | A | 2/1988 | Coppin et al. | |
| 4,989,549 | A * | 2/1991 | Korenberg | 122/149 |
| 5,024,170 | A | 6/1991 | Santanam et al. | |
| 5,029,557 | A | 7/1991 | Korenberg | |
| 5,944,512 | A * | 8/1999 | Ludwig | 432/72 |

* cited by examiner

*Primary Examiner* — Avinash Savani
(74) *Attorney, Agent, or Firm* — Bennett Jones LLP

(57) ABSTRACT

A cyclonic incinerator includes a cylindrical outer burn chamber having a defining wall, a central axis, a first end, a second end, and a forced air opening extending through the wall between the first end and the second end. A forced air manifold is provided which is adapted to direct forced air into the forced air opening of the outer burn chamber to create a cyclonic air flow about the central axis of the outer burn chamber. A cylindrical inner burn chamber is concentrically disposed within the outer burn chamber. The inner burn chamber has a defining wall, a first end and a second end. The first end of the inner burn chamber has an exhaust gas opening. The second end of the inner burn chamber is in communication with the outer burn chamber. A gas inlet is positioned at the first end of the outer burn chamber.

7 Claims, 2 Drawing Sheets

CYCLONIC INCINERATOR

FIELD

The present application relates to a cyclonic incinerator, more specifically, to a cyclonic incinerator for incinerating waste gases.

BACKGROUND

Incinerators are used to burn off waste gases in order to make them less harmful when released to the atmosphere. Cyclonic incinerators have a cyclonic flow pattern of hot gases. U.S. Pat. No. 5,029,557 (Korenberg) is an example of a cyclonic incinerator.

SUMMARY

There is provided a cyclonic incinerator which includes a cylindrical outer burn chamber having a defining wall, a central axis, a first end, a second end, and a forced air opening extending through the wall between the first end and the second end. A forced air manifold is provided which is adapted to direct forced air into the forced air opening of the outer burn chamber to create a cyclonic air flow about the central axis of the outer burn chamber. A cylindrical inner burn chamber is concentrically disposed within the outer burn chamber. The inner burn chamber has a defining wall, a first end and a second end. The first end of the inner burn chamber has an exhaust gas opening. The second end of the inner burn chamber is in communication with the outer burn chamber. A gas inlet is positioned at the first end of the outer burn chamber. An ignition source is provided which is adapted to ignite gas passing into the outer burn chamber through the gas inlet. The ignited gas continuously travels in the direction of the forced air from the first end of the outer burn chamber to the second end of the outer burn chamber, and from the second end of the inner burn chamber to the exhaust gas opening at the first end of the inner burn chamber.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
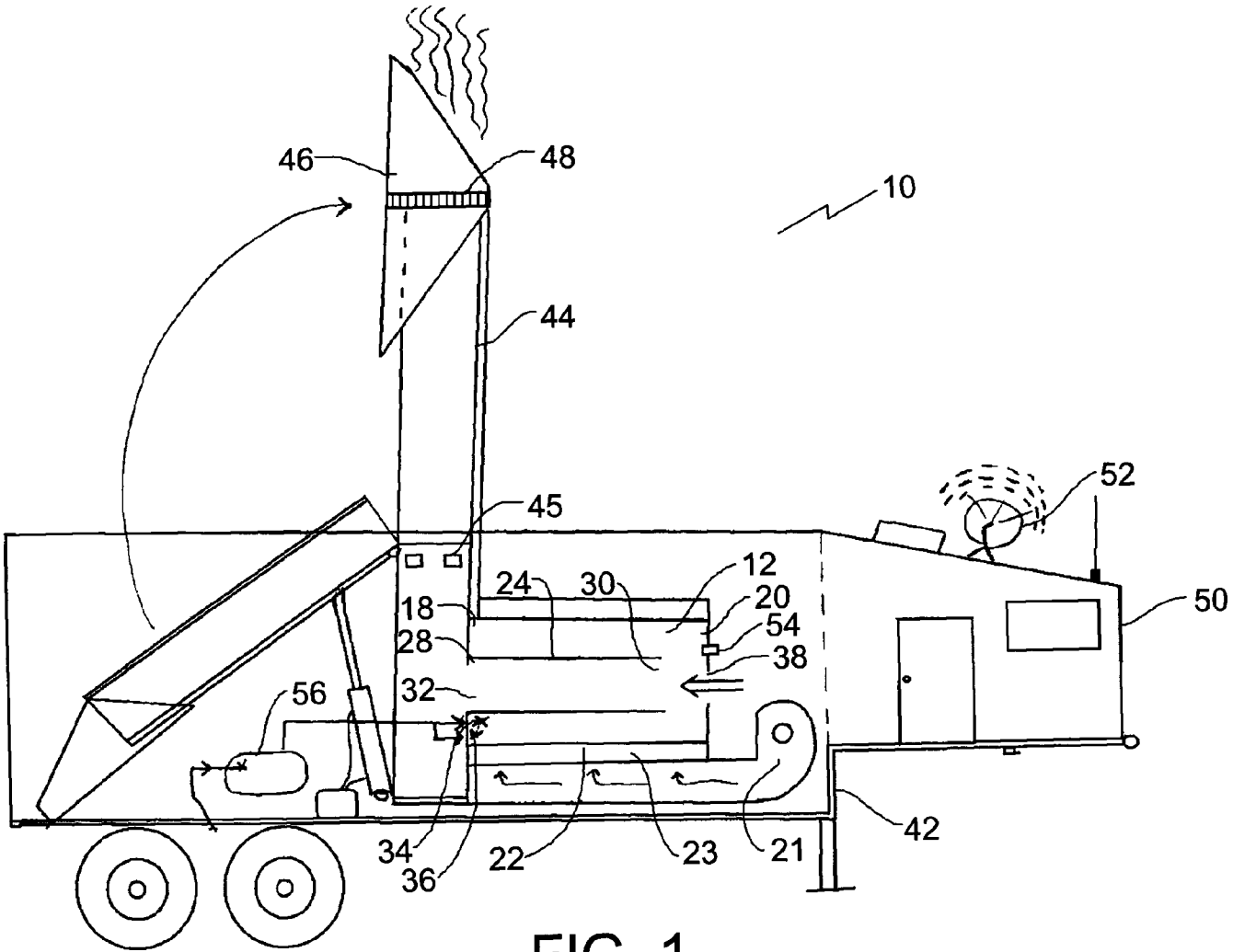
FIG. 1 is a side elevation view in partial section of a trailer-mounted cyclonic incinerator.

A cyclonic incinerator generally identified by reference numeral 10, will now be described with reference to FIG. 1 through 4.

Figure 2:
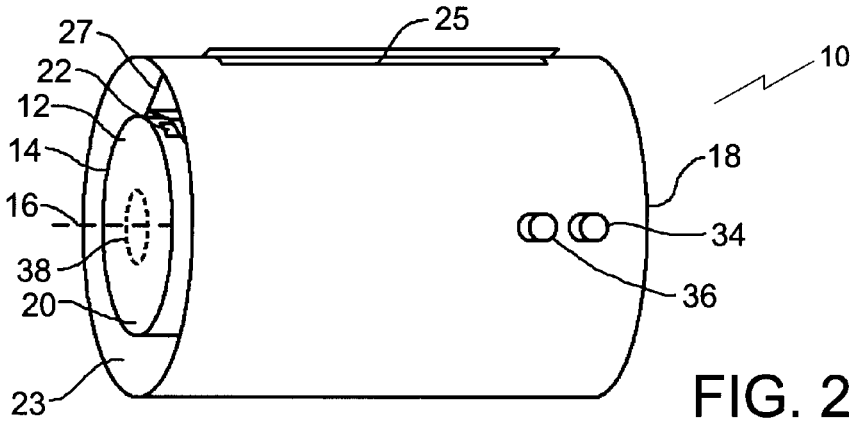
FIG. 2 is a perspective view of a cyclonic incinerator with the end removed.
Figure 3:
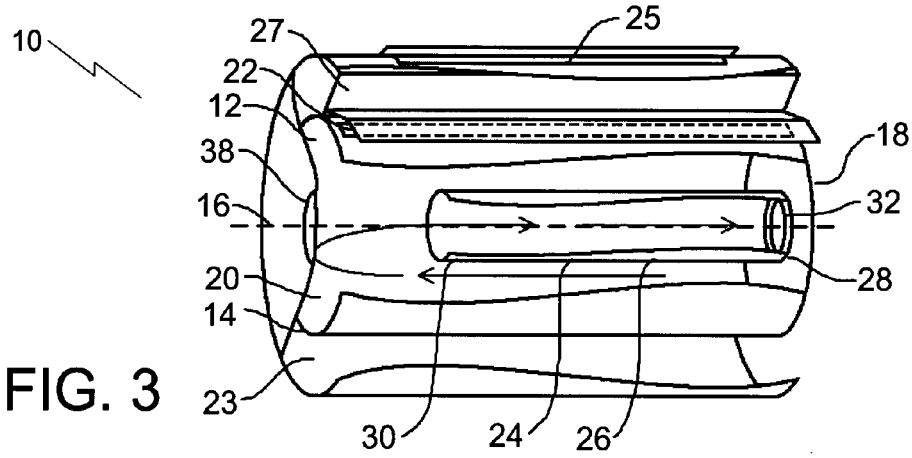
FIG. 3 is a perspective cutaway view of the cyclonic incinerator.

Structure and Relationship of Parts:

Referring to FIG. 2, cyclonic incinerator 10 includes a cylindrical outer burn chamber 12 that has a defining wall 14, a central axis 16, a first end 18 and a second end 20. Referring to FIG. 3, a forced air opening 22 extends through wall 14 between first end 18 and second end 20. A forced air manifold

Figure 4:
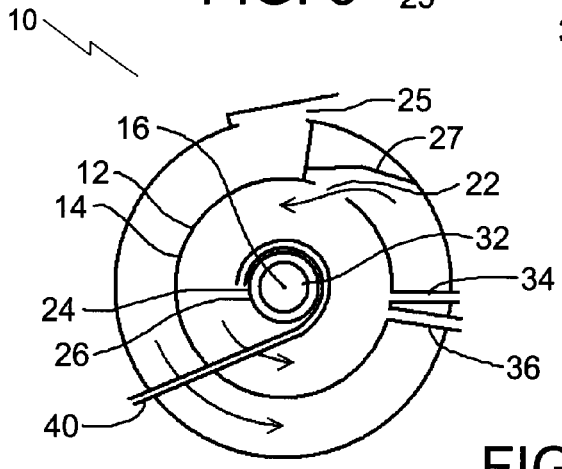
FIG. 4 is a end elevation view in section of the cyclonic incinerator.

23 directs forced air from a forced air unit 21 into forced air opening 22 of outer burn chamber 12 to create a cyclonic air flow about central axis 16 of outer burn chamber 12. Referring to FIG. 2, as depicted, forced air manifold 23 is cylindrical about outer burn chamber 12, such that air that is blown into manifold opening 25 travels nearly a full circle before entering forced air opening 22. A divider 27 directing the flow of air into opening 22. Referring to FIG. 3, a cylindrical inner burn chamber 24 is concentrically disposed within outer burn chamber 12 that has a defining wall 26, a first end 28 and a second end 30. First end 28 of inner burn chamber 24 has an exhaust gas opening 32, while second end 30 of inner burn chamber 24 is in communication with second end 20 of outer burn chamber 12. Referring to FIGS. 2 and 4, a gas inlet 34 is positioned at first end 18 of outer burn chamber 12. An ignition source 36 is located close to the gas inlet 34 to ignite gas passing into outer burn chamber 12 through gas inlet 36. As indicated by the arrows in FIG. 3, the ignited gas continuously travels in the direction of the forced air from first end 18 of outer burn chamber 12 to second end 20 of outer burn chamber 12, and then from second end 30 of inner burn chamber 24 to exhaust gas opening 32. The arrows in FIG. 4 show how the gas also rotates about axis 16 while moving in the directions shown in FIG. 3. Referring to FIG. 3, second end 20 of outer burn chamber 12 also has an atmospheric air opening 38, such that during operation the ignited gas passing into inner burn chamber 24 draws supplemental combustion air through atmospheric air opening 38. Referring to FIG. 4, chemical injection conduits 40 may be provided to inject chemicals into outer burn chamber 12, or inner burn chamber 24 (not shown). This may be done when chemical additives may improve the combustion of certain gases, or make the exhaust gases less harmful.

Referring now to FIG. 1, outer burn chamber 12 and inner burn chamber 24 are mounted on a trailer 42. An exhaust stack 44 is provided that is movable between a raised operative position and a lowered transport position. Plasma torches 45 may be included within exhaust stack 44 for high temperature destruction of certain exhaust gases, if necessary. Exhaust stack 44 is shown to have an adjustable acoustic direction manifold 46 that is adapted to redirect sound such that the majority of the sound travels in a selected direction. This is adjustable by rotating manifold 46 using a gear arrangement 48. Other features, such as an operator's booth 50, a communication system 52, and a combustion camera 54 to monitor the burn of gases may also be included on trailer 42. As shown, gas to be burned is directed through a gas manifold 56 which delivers the gas to gas inlet 34.

Operation:

Referring to FIG. 1, a trailer-mounted cyclonic incinerator 10 is driven to a site where gas, such as waste gas from a well is to be flared. Exhaust stack 44 is then raised, and the position of adjustable direction manifold 46 is chosen such that the sound is directed away from any sound-sensitive areas, such as a nearby farm. The waste gas is directed through gas manifold 54 into gas inlet 34. Air is forced by forced air unit 21 through forced air manifold 23 and into forced air opening 22. Referring to FIGS. 3 and 4, forced air opening 22 extends along the length of outer burn chamber 12 such that a cyclonic flow is created about central axis 16. Referring to FIG. 4, as air passes through forced air opening 22, it mixes with gas from gas inlet 34, and this mixture is then ignited by ignition source 36. The ignited gas mixture then continues to travel about central axis 16 as depicted by the arrows in FIG. 4. Referring to FIG. 3, the ignited gas mixture also travels toward second end of outer burn chamber 12, then through second end 30 of inner burn chamber 24 toward the exhaust gas opening 32 at first end 28 of inner burn chamber 24. As the ignited gas mixture travels in this direction, supplemental air to feed the combustion is drawn from atmosphere through atmospheric air opening 38.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope defined in the Claims.

What is claimed is:

1. A cyclonic incinerator, comprising:

a cylindrical outer burn chamber having a defining wall, a central axis, a first end, a second end, wherein the defining wall defines an elongate forced air opening extending substantially from the first end to the second end;

a forced air manifold concentrically disposed outside the outer burn chamber, having an elongate manifold opening extending substantially the entire length of the forced air opening, and adapted to direct forced air into the forced air opening of the outer burn chamber to create a cyclonic air flow about the central axis of the outer burn chamber;

a cylindrical inner burn chamber concentrically disposed within the outer burn chamber, the inner burn chamber having a defining wall, a first end and a second end, the first end of the inner burn chamber having an exhaust gas opening, the second end of the inner burn chamber being in communication with the outer burn chamber;

a gas inlet positioned at the first end of the outer burn chamber;

an ignition source adapted to ignite gas passing into the outer burn chamber through the gas inlet; such that the ignited gas continuously travels in the direction of the forced air from the first end of the outer burn chamber to the second end of the outer burn chamber, and from the second end of the inner burn chamber to the exhaust gas opening at the first end of the inner burn chamber.

2. The cyclonic incinerator of claim 1, wherein the second end of the outer burn chamber has an additional atmospheric air opening, such that during operation the ignited gas passing into the inner burn chamber draws supplemental combustion air through the atmospheric air opening.

3. The cyclonic incinerator of claim 1, wherein chemical injection conduits are provided to inject chemical into one of the outer burn chamber or the inner burn chamber.

4. The cyclonic incinerator of claim 1, wherein the outer burn chamber and the inner burn chamber are trailer mounted.

5. The cyclonic incinerator of claim 4, wherein an exhaust stack is provided that is movable between a raised operative position and a lowered transport position relative to the trailer.

6. The cyclonic incinerator of claim 5, wherein the exhaust stack has an adjustable direction manifold, adapted to direct sound in a selected direction.

7. The cyclonic incinerator of claim 1 wherein the elongate manifold opening is separated from the elongate forced air opening by a divider such that forced air travels nearly a full circle within the forced air manifold.

* * * * *